US005298639A

United States Patent [19]

Toeneboehn et al.

[11] Patent Number: 5,298,639

[45] Date of Patent: Mar. 29, 1994

[54] MPR PROCESS FOR TREATING GLYCERIDE OILS, FATTY CHEMICALS AND WAX ESTERS

[75] Inventors: Gabriella J. Toeneboehn, Columbia; Walter M. Cheek, III, Baltimore; William A. Welsh, Highland; James M. Bogdanor, Columbia, all of Md.

[73] Assignee: W. R. Grace & Co.-Conn., New York, N.Y.

[21] Appl. No.: 981,648

[22] Filed: Nov. 25, 1992

Related U.S. Application Data

[63] Continuation of Ser. No. 677,455, Apr. 3, 1991, abandoned.

[51] Int. Cl.[5] ..... C11B 3/10

[52] U.S. Cl. ..... 554/192; 554/191

[58] Field of Search ..... 554/192, 191

[56] References Cited

U.S. PATENT DOCUMENTS 4,939,115 7/1990 Parker et al. ..... 502/401

FOREIGN PATENT DOCUMENTS 247411 12/1987 European Pat. Off. .

*Primary Examiner*—José G. Dees
*Assistant Examiner*—Deborah D. Carr
*Attorney, Agent, or Firm*—Steven Capella

[57] ABSTRACT

A modified physical adsorption process is described in which small quantities of caustic are added to glyceride oils, fatty chemicals or wax esters having an FFA level sufficient to create about 20 to 3,000 ppm soaps. The soaps, together with impurities, are removed by adsorption onto amorphous silica.

15 Claims, No Drawings

MPR PROCESS FOR TREATING GLYCERIDE OILS, FATTY CHEMICALS AND WAX ESTERS

This is a continuation of application Ser. No. 677,455, filed Apr. 3, 1991, now abandoned.

BACKGROUND OF THE INVENTION

This invention relates to a method for refining, reclaiming or reradiating glyceride oils, fatty chemicals and wax esters by contacting them with an adsorbent capable of removing certain impurities. The method has been designated "MPR", which may refer to modified physical refining, modified physical reclamation or modified physical remediation. MPR is intended to refer to any treatment of glyceride oils, fatty chemicals or wax esters according to the procedures of the invention described herein, regardless of the stage of refining, use or re-use of the composition being treated. MPR will be useful in treating these materials whether they are intended for food-related or for non-food-related applications.

The MPR method combines the benefits of caustic treatment and physical adsorptive treatment, while eliminating the key disadvantages of each process. It previously had been found that amorphous silicas are made more effective in adsorbing phospholipids from caustic treated or caustic refined glyceride oils by the presence of soaps in the oils. It now has been discovered that the addition of only very minor amounts of caustic creates sufficient, though small, quantities of soap to enhance phospholipid adsorption on amorphous silica.

For purposes of this specification, the term "impurities" refers to soaps and phospholipids. The phospholipids are associated with metal ions and together they will be referred to as "trace contaminants." The term "glyceride oils" as used herein is intended to encompass both vegetable and animal oils. The term is primarily intended to describe the so-called edible oils, i.e., oils derived from fruits or seeds of plants and used chiefly in foodstuffs, but it is understood that oils whose end use is as non-edibles are to be included as well. In addition, the process of this invention may be used with other fatty chemicals and wax esters where phospholipids and associated metal ions are contaminants which must be removed.

The presence of phosphorus-containing trace contaminants can lend off colors, odors and flavors to the finished oil product. These compounds are phospholipids, with which are associated ionic forms of the metals calcium, magnesium, iron and copper. For purposes of this invention, references to the removal or adsorption of phospholipids is intended also to refer to removal or adsorption of the associated metal ions.

In the preferred embodiment of this invention, the terms "glyceride oil," "crude glyceride oil," "degummed oil," "caustic refined oil," "oil" and the like as used herein refer to the oil itself, including impurities and contaminants such as those discussed in this specification. These are substantially pure oils at about 99.8% or higher oil content, with respect to solvents (*Handbook of Soy Oil Processing and Utilization,* pp. 55–56 (1980)). That is, the glyceride oils utilized in the preferred embodiment are substantially pure oils, in the complete absence or substantially complete absence of solvents such as hexane. Notwithstanding this purity with respect to solvents, it will be understood that the oils do contain contaminants, such as phosphorus, free fatty acids, etc., as described in detail below. Similarly, fatty chemicals and wax esters preferably are treated in substantially pure states, in the complete or substantially complete absence of solvents. In these preferred embodiments, the method of this invention can be categorized as non-miscella refining, remediation or reclamation.

This contrasts to solvent/oil solutions, or miscella as referred to by the industry. The initial oil extraction process in which oils are removed from seeds typically is done by solvent extraction (e.g., with hexane). The result is a solvent/oil solution which may be 70–75% solvent. Refining methods which utilize this solution commonly are referred to as miscella refining. In an alternative embodiment, the methods of this invention can be applied to miscella refining, remediation or reclamation. This conveniently may take place immediately after solvent extraction, for miscella refining. Alternatively, solvent/oil solution may be prepared at any stage of refining or use, for miscella refining, remediation or reclamation. All descriptions contained herein which are directed to non-miscella processing may be applied as well to solvent/oil miscella.

With respect to initial refining applications, crude glyceride oils, particularly vegetable oils, are refined by a multi-stage process, the first step of which typically is "degumming" or "desliming" by treatment with water or with a chemical such as phosphoric acid, malic acid, citric acid or acetic anhydride, followed by centrifugation. This treatment removes some but not all gums and certain other contaminants. Some of the phosphorus content of the oil is removed with the gums.

Either crude or degummed oil may be treated in a traditional chemical, or caustic, refining process. The addition of an alkali solution, caustic soda for example, to a crude or degummed oil causes neutralization or substantial neutralization of free fatty acids ("FFA") to form alkali metal soaps. In traditional caustic refining, an excess of caustic over FFA is added to ensure that neutralization of all or substantially all FFA takes place. The following equation, used where the caustic is lye, is used to calculate the amount of caustic solution to be added ("wt% lye"), which varies with the FFA content and with the concentration of the caustic ("% NaOH in solution"):

$$\text{wt \% lye} = \frac{[(\%\ FFA \times 0.142) + \%\ \text{excess NaOH}] \times 100}{\%\ \text{NaOH in solution}}, \quad (1)$$

(*Handbook of Soy Oil Processing and Utilization,* pp. 90–91 (1980)). The term "% excess NaOH" refers to a mathematical excess selected to ensure neutralization of FFA; typically this is at least 10% (entered into the equation in decimal form as "0.1").

This neutralization step in the traditional caustic refining process will be referred to herein as "caustic treatment" and oils treated in this manner will be referred to as "caustic treated oils"; these terms will not be used herein to refer to the small quantities of caustic added in the MPR process of this invention. The large quantity of soaps (typically at least 7500–12,500 ppm) generated during traditional caustic treatment is an impurity which must be removed from the oil because it has a detrimental effect on the flavor and stability of the finished oil. Moreover, the presence of soaps is harmful to the acidic and neutral bleaching agents and catalysts used in the oil bleaching and hydrogenation processes, respectively.

Prevalent industrial practice in traditional caustic refining is to first remove soaps by centrifugal separation (referred to as "primary centrifugation"), followed by a water wash and second centrifuge. The waste from this first centrifuge is frequently acidulated to produce FFA, which is removed. The remaining acidified water requires costly disposal. Additionally, this step is responsible for high neutral oil loss ("NOL") due to entrainment of oil in the soap phase. Generally, the primary centrifugation is followed by water wash and a second centrifugation in order to reduce the soap content of the oil below about 50 ppm. The water-washed oil then must be dried to remove residual moisture to below about 0.1 weight percent. The dried oil is then either transferred to the bleaching process or is shipped or stored as oncerefined oil.

A significant part of the waste discharge from the caustic refining of vegetable oil results from the centrifugation and water wash process used to remove soaps. In addition, in the traditional caustic refining process, some oil is lost in the water wash process. Moreover, the dilute soapstock must be treated before disposal, typically with an inorganic acid such as sulfuric acid in a process termed acidulation. Sulfuric acid is frequently used. It can be seen that quite a number of separate unit operations make up the soap removal process, each of which results in some degree of oil loss. The removal and disposal of soaps and aqueous soapstock is one of the most considerable problems associated with the caustic refining of glyceride oils.

An improved, or modified, caustic refining process is taught in European Patent Publication No. 0247411. This modified caustic refining ("MCR") process removes soaps and phospholipids from caustic treated or caustic refined oils in a single unit operation by adsorption of these contaminants onto amorphous silica. The water wash centrifuge steps are eliminated, along with the waste streams and NOL associated with those steps. However, in MCR, as in traditional caustic refining, very large quantities of soaps still are generated by neutralization of free fatty acids. The present MPR process seeks to advance the art further by reducing initial soaps, adsorbent loadings and NOL as compared with the previous MCR process.

An additional consequence of the formation and removal of large quantities of soaps in traditional or modified caustic refining processes is that significant amounts of natural antioxidants (e.g., tocopherol) are removed with the soaps. This is detrimental to the oil, reducing its oxidative stability. Moreover, valuable vitamins (such as vitamin A in fish oils) may also be lost in the soap removal process.

Alternatively, oil may be treated by traditional physical refining. A primary reason for refiners' use of the physical refining process is to avoid the wastestream production associated with removal of soaps generated in the caustic refining process: since no caustic is used in physical refining, no soaps are generated. Following degumming, the oil is treated with one or more adsorbents to remove the trace contaminants, and to remove color, if appropriate. Physical refining processes do not include any addition of caustic and no soaps are generated. Although physical refining does eliminate problems associated with soap generation in caustic refining, quality control in physical refining processes has proven difficult, particularly where clays are used as the adsorbent. In addition, large quantities of clay adsorbents are required to achieve the low contaminant levels desired by the industry and there is considerable neutral oil loss associated with use of such large quantities of clay.

U.S. Pat. No. 4,629,588 (Welsh et al.) discloses a physical adsorption process in which amorphous silica adsorbents are used to remove trace contaminants from glyceride oils. The Welsh process is particularly effective when the phospholipids present in the oil are in hydratable form. The process is less effective in treating oils which have been dried (e.g., for storing), in which the phospholipids have been dehydrated to a more difficult-to-remove form.

SUMMARY OF THE INVENTION

A modified physical adsorption process (MPR) has been found whereby the adsorption of trace contaminants (phospholipids and metal ions) from glyceride oils onto amorphous silica is enhanced by the addition of very minor amounts of caustic or other strong base to create just sufficient quantities of soaps to enhance the adsorptive capacity of the silica. This unique MPR process is essentially a physical adsorption which completely eliminates the need to add large quantities of caustic and therefore also eliminates the need to remove the large quantities of soaps typically generated in caustic treatment and caustic refining of oils. In addition, the MPR process of this invention uses significantly less adsorbent than necessary in traditional physical refining. The process described herein utilizes amorphous silica adsorbents preferably having an average pore diameter of greater than 50 to 60Å which can remove all or substantially all soaps from the oil and which reduce the phosphorus content of the oil to at least below 15 parts per million, preferably below 5 parts per million, most preferably substantially to zero.

It is the primary object of this invention to provide a single unit operation which has the advantages of traditional physical and either traditional caustic or modified caustic refining, while eliminating the disadvantages of each. That is, it is expected that the generally excellent oil quality of caustic refining will be achieved while eliminating the several unit operations required when water-washing and centrifugation must be employed to remove soaps generated in traditional caustic refining. I addition, this new method will eliminate the need for wastewater treatment and disposal from those operations. Over and above the cost savings realized from this tremendous simplification of the oil processing, it is expected that the overall value of the product will be increased since two significant by-products of conventional caustic refining are concentrated soapstock (from primary centrifuge) and dilute aqueous soapstock (wastewater), which are of very low value and which may represent a significant liability since substantial treatment is required before disposal is permitted by environmental authority. Moreover, significant reduction of caustic usage results in both economic and safety benefits.

It is a further object to develop a modified physical adsorption process which has advantages over the modified caustic refining (MCR) process described above. Although MCR also eliminates water-washing and centrifugation, etc., large quantities of caustic are still required in the primary caustic treatment step, which generates large quantities of concentrated soapstock to be removed. The previous MCR process therefore still results in high neutral oil losses due to entrainment of oil in the soaps, saponification of triglycerides and adsorption of oil. On the other hand, it is expected that the MPR process of this invention will significantly reduce NOL, since much lower quantities of caustic are used and much less soap is created.

Still further, it is intended that the MPR process will have advantages over traditional physical refining. Adsorbent usage will be reduced dramatically by use of MPR, reducing neutral oil loss from adsorption as well. Oil quality is expected to be excellent and more consistent results achieved using the MPR process as compared with traditional physical refining.

Another important object of this invention is to provide an adsorption process which can be applied to treatment of oils in initial refining, to remediation of damaged or difficult-to-refine oils and to reclamation of spent or used oils.

It is an overall object of this invention to produce oils of consistently high quality. Specific objects are producing oils exhibiting good oxidative stability, acceptable taste, and low final color levels. Oils with better oxidative stability are produced as a result of allowing greater amounts of natural antioxidants to remain in the oil throughout the treatment process.

DETAILED DESCRIPTION OF THE INVENTION

The present invention as applied to refining is an improvement of the MCR (modified caustic refining) process, although changing that process so substantially that the present process is termed modified physical refining (MPR) since it is considered to more closely resemble physical refining than caustic refining. Nonetheless, elements of both are present. Whereas no caustic is introduced in traditional physical refining, the present process does use small quantities of caustic, just enough to form small quantities of soaps by partially neutralizing free fatty acids present in the oil. This contrasts with the caustic refining processes, which use large amounts of caustic sufficient to neutralize the free fatty acid content of the oil, creating large quantities of soaps which must be removed. In fact, a stoichiometric excess of caustic with respect to FFA is normally used in conventional or modified caustic refining processes.

It was taught in the MCR process of EP 0247411 that amorphous silicas are particularly well suited for removing both soaps and phospholipids from caustic refined glyceride oils. The soaps do not "blind" the adsorbent to the phospholipids. Moreover, it was found that the presence of increasing levels of soap in the oil to be treated actually enhances the capacity of amorphous silica to adsorb phosphorus. That is, the presence of soaps at levels below the maximum adsorbent capacity of the silica makes it possible to substantially reduce phosphorus content at lower silica usage than required in the absence of soaps. In MCR, the high soap levels produced during neutralization of FFAs by caustic treatment were believed necessary and desirable in order to maximize the adsorptive capacity of the silica.

By contrast to the traditional or modified caustic refining processes, in the present MPR process oils comprising FFAs are treated with very small quantities of caustic to create soaps at levels of about 20 to 3000 ppm, preferably 50 to 1500 ppm, more preferably 100 to 1000 ppm, and most preferably 300–800 ppm. The treated oil is then contacted with an amorphous silica adsorbent, onto which soaps and phospholipids are adsorbed. The adsorbent-treated oil is then separated from the adsorbent. Where the initial FFA content of the oil is only partially neutralized, FFA remaining after treatment by MPR may be removed by distillative deodorization, by adsorption onto an FFA-adsorbent or by any convenient means.

The Oils

The process described herein can be used for the removal of trace contaminants from any glyceride oil, for example, vegetable oils of soybean, peanut, rapeseed, corn, sunflower, palm, coconut, olive, cottonseed, rice bran, safflower, flax seed, etc. or animal oils or fats such as tallow, lard, milk fat, fish liver oils, etc. In refining applications, the oils may be crude or degummed. In remediation applications, the oils may be at any stage of refining or use. In reclamation, the oils will have been used for their desired purpose (e.g., frying). As stated above, the term "glyceride oil" will be intended to encompass fatty chemicals and wax esters, except where otherwise specified.

The MPR treatment process is not limited to use with glyceride oils. Fatty chemicals other than glyceride oils, for example, fatty acids, fatty alcohols, transesterified fats, re-esterified oils, and synthetic oils, such as Olestra TM oil substitute (Procter and Gamble Co.), may also be treated by this process to remove impurities such as phosphorus and soaps. For example, wax esters (such as jojoba oil) may contain phospholipids and metal ions which can be removed by MPR. Also, some marine oils which are not glyceride oils may be treated by this invention, as may other fatty acids, fatty alcohols. It can be seen that the treated compositions may be used for food-related or non-food-related applications. The latter include soap and cosmetic manufacture, detergents, paints, leather treatment, coatings and the like.

As stated above, the oils used in the preferred embodiment of this process are completely or substantially completely free of solvents. Alternatively, oil-solvent solutions may be treated by-MPR. The processes described below may be applied to the oils either in the presence or absence of solvents. The MPR process is applicable to initial refining, to remediation of damaged or difficult-to-refine oils, and to treatment to remove trace contaminants at later stages, such as in reclamation of used cooking oils.

Table I summarizes typical trace contaminant, soap and free fatty acid levels for soybean oils in various stages of treatment by traditional physical, traditional caustic, modified caustic (MCR) and modified physical refining (MPR) processes. Industry targets for the various contaminants are also given, with respect to the fully refined product. Fully refined oils processed by any method must have soap values approaching zero. The MPR process disclosed herein is capable of reducing soaps to levels acceptable to the industry, that is, less than about 10 ppm, preferably less than about 5 ppm, most preferably about zero ppm.

Removal of trace contaminants (phospholipids and associated metal ions) from edible oils is a significant step in the oil refining process because they can cause off colors, odors and flavors in the finished oil. Typically, the acceptable concentration of phosphorus in the finished oil product should be less than about 15.0 ppm, preferably less than about 5.0 ppm, according to general industry practice. As an illustration of the refining goals with respect to trace contaminants, typical phosphorus levels in soybean oil at various stages of chemical and physical refining processes are shown in Table I. Other glyceride oils, fatty chemicals and wax esters will exhibit somewhat different contaminant profiles.

TABLE I[1]

| Treatment | Trace Contaminant Levels (ppm) for Soybean Oil | | | | | | |
|---|---|---|---|---|---|---|---|
| | P | Ca | Mg | Fe | Cu | Soaps | FFA (%) |
| Crude Oil | 450–750 | 1–5 | 1–5 | 1–3 | .03–.05 | 0 | 0.5–1.25 |
| Degummed Oil | 60–200 | 1–5 | 1–5 | .4–.5 | .02–.04 | 0 | 0.5–1.25 |
| Trade. Phys. Ref. Oil | | | | | | 0 | 0.02–0.05 |
| Trad. Caustic Tr. Oil[2] | 60–750 | 1–5 | 1–5 | .4–.3 | .02–.05 | 7500–12,500 | 0.1 |
| Trad. Caustic Ref. Oil | 10–15 | 1 | 1 | 0.3 | .003 | 10–50 | 0.01–0.15 |
| MCR-Treated Oil | <5.0 | <0.5 | <0.5 | <0.1 | <.003 | 0 | 0.01–0.15 |
| MPR-Treated Oil | <5.0 | <0.5 | <0.5 | <0.1 | <.003 | 0 | 0.01–0.15 |
| Industry Targets for Fully Refined SBO[3] | 1–15 | 1 | 1 | .1–.3 | .003 | 0 | .01–.05 |

[1]Data assembled from the Handbook of Soy Oil Processing and Utilization, Table I, p. 14, p. 91, p. 119, p. 294, pp. 378–81 (1980); from FIG. 1 from Christenson, Short Course: Processing and Quality Control of Fats and Oils, presented at American Oil Chemists' Society, Lake Geneva, WI (May 5–7, 1983); from Strecker et al., "Quality Characteristics and Properties of the Principal World Oils When Processed by Physical Refining," Proc. of the World Conf. on Emerging Technologies, AOCS, pp. 51–55 (1986); and from actual field and laboratory data.
[2]Either Crude Oil or Degummed Oil may be used to prepare oil for traditional or modified caustic treatment.
[3]Some FFA remaining after the various processes listed above will come out of the oil during deodorization, enabling the oil to meet industry targets.

In addition to phospholipid removal, the process of this invention also removes from edible oils ionic forms of the metals calcium, magnesium, iron and copper, some of which are believed to be chemically associated with phospholipids, and which are removed in conjunction with the phospholipids. Additionally, these metals may be associated with FFA in the form of metallic soaps. These metal ions themselves have a deleterious effect on the refined oil products. Calcium and magnesium ions can result in the formation of precipitates, particularly with free fatty acids, resulting in undesired soaps in the finished oil. The presence of iron and copper ions promote oxidation of the oils, resulting in poor oxidative stability. Moreover, each of these metal ions is associated with catalyst poisoning where the refined oil is catalytically hydrogenated. Nickel, if present, will also be removed during MPR processing. Nickel may be present as colloidal nickel or nickel soaps in oils following hydrogenation; MPR may be used for nickel removal if sufficient FFA is present, or is added, for soap formation. Other metals may be present. For glyceride oils, particularly animal fats and milk fats, the metal content will depend largely on local soil contaminants.

The amorphous silica adsorbents described herein will remove both ionic forms of these metal ions and metal-soaps which may be formed. Typical concentrations of these metals in soybean oil at various stages of chemical refining are shown in Table I. Throughout the description of this invention, unless otherwise indicated, reference to the removal of phospholipids is meant to encompass the removal of associated metal ions as well.

The Caustic

Any convenient caustic or other strong base may be used in this process, providing it is compatible with the end use of the oil, fatty chemical or wax ester to be treated. Where the term "caustic" appears, it is intended to refer to those caustics typically used in conventional caustic treatment processes and also to other strong bases as described herein, unless otherwise indicated. For example, only caustics or other bases suitable for use in food preparation should be used in refining, reclaiming or remediating edible oils. Sodium hydroxide solutions (about 2.0 to about 15.0 wt%) are preferred. Lower concentrations, e.g., about 5.0 wt%, may be advantageous. It is believed that such concentrations may allow for more intimate mixture of the caustic and the oil.

Organic bases, such as amines or ethoxides, (for example, sodium methoxide or sodium ethoxide) may be used. Solid bases may be used, such as sodium carbonate, sodium bicarbonate, potassium carbonate, calcium carbonate, calcium hydroxide, magnesium hydroxide, tetrasodium pyrophosphate, potassium hydroxide, trisodium phosphate and the like. Alcohol solutions of bases (e.g., 5 wt% sodium hydroxide in ethanol) may be used, and may be preferred since the alcohol solution affords increased miscibility with the oil for good soap formation.

The caustic may be added in a supported form if desired. Caustic is mixed with a porous support in such a manner that the caustic is supported in the pores of the support to yield a caustic-treated porous inorganic support. For example, a caustic solution may be supported in the pores of an inorganic porous adsorbent or support which can be mixed with, and then removed from, the oil. This may be desired where, for example, a refiner does not have the capability for adding caustic in solution form.

In one embodiment, the amorphous silica used here for adsorption of impurities may be impregnated with caustic. The caustic and amorphous silica adsorbent are thus simultaneously added to the oil. Alternatively, the caustic may be supported on another inorganic porous support, with the amorphous silica adsorbent added separately as described below.

Where it is desired to use a caustic-impregnated porous inorganic adsorbent, it may be prepared as follows. The inorganic porous support suitable for use in the invention is selected from the group consisting of amorphous silica, substantially amorphous alumina, diatomaceous earth, clay, zeolites, activated carbon, magnesium silicates and aluminum silicates. The basetreated inorganic porous adsorbents of this invention are characterized by being finely divided, having a surface area in the range from 10 to 1200 square meters per gram, having a porosity such that said adsorbent is capable of soaking up to at least 20 percent of its weight in moisture. Where the porous support is the amorphous silica adsorbent used in this invention, it should have the adsorbent characteristics described below.

The inorganic porous support is treated with the caustic in such a manner that at least a portion of the caustic is retained in at least some of the pores of the porous support. The caustic should be selected such that it will not substantially adversely affect the structural integrity of the support.

It is desired that at least a portion of the pores in the adsorbent contain either a pure caustic or an aqueous solution thereof diluted to a concentration as low as about 0.05M. The caustics may be used singly or in combination. The preferred concentration is generally at least about 0.25M. However, sodium hydroxide in higher concentrations, i.e., solutions above 5%, will cause decrepitation of a silica adsorbent; therefore, sodium hydroxide should be used at lower concentration levels and dried quickly.

It is preferred, for reasons of filterability, that the total weight percent moisture (measured by weight loss on ignition at 955° C.) of the caustictreated inorganic adsorbent be at least about 10% to about 80%, preferably at least about 30%, most preferably at least about 50 to 60%. The greater the moisture content of the adsorbent, the more readily the mixture filters.

The Adsorbent

The term "amorphous silica" as used herein is intended to embrace silica gels, precipitated silicas, dialytic silicas and fumed silicas in their various prepared or activated forms. In addition, it may be desired to use amorphous silica adsorbents on which various acids are supported to enhance adsorption. Moreover, as described above, the caustic to be added in the MPR process of this invention can be supported on the silica adsorbent, rather than added to the oil separately. In addition, the adsorbents used in the MPR process may either be substantially pure amorphous silica or may have an amorphous silica component which performs the described adsorptions. The invention is considered to cover the latter adsorbents as well, notwithstanding the presence of one or more non-silica adsorptive compositions.

Silica gels and precipitated silicas are prepared by the destabilization of aqueous silicate solutions by acid neutralization. In the preparation of silica gel, a silica hydrogel is formed which then typically is washed to low salt content. The washed hydrogel may be milled, or it may be dried, ultimately to the point where its structure no longer changes as a result of shrinkage. The dried, stable silica is termed a xerogel. In the preparation of precipitated silicas, the destabilization is carried out in the presence of polymerization inhibitors, such as inorganic salts, which cause precipitation of hydrated silica. The precipitate typically is filtered, washed and dried. For preparation of gels or precipitates useful in this invention, it is preferred to initially dry the gel or precipitate to the desired water content. Alternatively, they can be dried and then water can be added to reach the desired water content before use. Dialytic silica is prepared by precipitation of silica from a soluble silicate solution containing electrolyte salts (e.g., $NaNO_3$, $Na_2SO_4$, $KNO_3$) while electrodialyzing, as described in U.S. Pat. No. 4,508,607. Fumed silicas (or pyrogenic silicas) are prepared from silicon tetrachloride by high-temperature hydrolysis, or other convenient methods. The specific manufacturing process used to prepare the amorphous silica is not expected to affect its utility in this method.

In the preferred embodiment of this invention, the silica adsorbent will have the highest possible surface area in pores which are large enough to permit access to the soap and phospholipid molecules, while being capable of maintaining good structural integrity upon contact with the oil. The requirement of structural integrity is particularly important where the silica adsorbents are used in continuous flow systems, which are susceptible to disruption and plugging. Amorphous silicas suitable for use in this process have surface areas of up to about 1200 square meters per gram, preferably between 100 and 1200 square meters per gram. It is preferred, as well, for as much as possible of the surface area to be contained in pores with diameters greater than 50 to 60Å, although amorphous silicas with smaller pore diameters may be used. In particular, partially dried amorphous silica hydrogels having an average pore diameter less than 60Å (i.e., down to about 20Å) and having a moisture content of at least about 25 weight percent will be suitable.

The method of this invention utilizes amorphous silicas, preferably with substantial porosity contained in pores having diameters greater than about 20Å, preferably greater than about 50 to 60Å, as defined herein, measured after appropriate activation. Activation for this measurement typically is accomplished by heating to temperatures of about 450 to 700° F. in vacuum, and results typically are reported on an $SiO_2$ basis. One convention which describes silicas is average (median) pore diameter ("APD"), typically defined as that pore diameter at which 50% of the surface area or pore volume is contained in pores with diameters greater than the stated APD and 50% is contained in pores with diameters less than the stated APD. Thus, in amorphous silicas suitable for use in the method of this invention, at least 50% of the pore volume or surface area will be in pores of at least 20Å, preferably 50 to 60Å, in diameter. Silicas with a higher proportion of pores with diameters greater than 50 to 60Å will be preferred, as these will contain a greater number of potential adsorption sites. The practical upper APD limit is about 5000Å.

Silicas which have measured intraparticle APDs within the stated range will be suitable for use in this process. Alternatively, the required porosity may be achieved by the creation of an artificial pore network of interparticle voids in the 50 to 5000Å range. For example, non-porous silicas (i.e., fumed silica) or silicas with APDs of less than 60Å can be used as aggregated particles. Silicas, with or without the required porosity, may be used under conditions which create this artificial pore network. Thus the criterion for selecting suitable amorphous silicas for use in this process is the presence of an "effective average pore diameter" greater than 20Å, preferably greater than 50 to 60Å. This term includes both measured intraparticle APD and interparticle APD, designating the pores created by aggregation or packing of silica particles.

The APD value (in Angstroms) can be measured by several methods or can be approximated by the following equation, which assumes model pores of cylindrical geometry:

$$APD\ (\text{Å}) = \frac{40{,}000 \times PV\ (\text{cc/gm})}{SA\ (\text{m}^2/\text{gm})}, \qquad (2)$$

where PV is pore volume (measured in cubic centimeters per gram of solid) and SA is surface area (measured in square meters per gram of solid).

Both nitrogen and mercury porosimetry may be used to measure pore volume in xerogels, precipitated silicas and dialytic silicas. Pore volume may be measured by the nitrogen Brunauer-Emmett-Teller ("B-E-T") method described in Brunauer et al., J. Am. Chem. Soc., Vol 60, p. 309 (1938). This method depends on the condensation of nitrogen into the pores of activated silica and is useful for measuring pores with diameters up to about 600Å. If the sample contains pores with diameters greater than about 600Å, the pore size distribution, at least of the larger pores, is determined by mercury porosimetry as described in Ritter et al., Ind. Eng. Chem. Anal. Ed. 17,787 (1945). This method is based on determining the pressure required to force mercury into the pores of the sample. Mercury porosimetry, which is useful from about 30 to about 10,000Å, may be used alone for measuring pore volumes in silicas having pores with diameters both above and below 600Å. Alternatively, nitrogen porosimetry can be used in conjunction with mercury porosimetry for these silicas. For measurement of APDs below 600Å, it may be desired to compare the results obtained by both methods. The calculated PV volume is used in Equation (2).

For determining pore volume of hydrogels, a different procedure, which assumes a direct relationship between pore volume and water content, is used. A sample of the hydrogel is weighed into a container and all water is removed from the sample by vacuum at low temperatures (i.e., about room temperature). The sample is then heated to about 450 to 700° F. to activate. Alternatively, the silica may be dried and activated by ignition in air at 1750° F. After activation, the sample is re-weighed to determine the weight of the silica on a dry basis ("db"), and the pore volume is calculated by the equation:

$$PV\,(\text{cc/gm}) = \frac{\%\ TV}{100 - \%\ TV}, \tag{3}$$

where TV is total volatiles, determined as in the following equation by the wet and dry weight differential:

$$TV = 100 \times \left[ \frac{\text{Silica (as is, gm)} - \text{Silica (}db\text{, gm)}}{\text{Silica (as is, gm)}} \right]. \tag{4}$$

For all amorphous silicas, the surface area measurement in the APD equation is measured by the nitrogen B-E-T surface area method, described in the Brunauer et al., article, supra. The surface area of all types o appropriately activated amorphous silicas can be measured by this method. The measured SA is used in Equation (2) with the measured or calculated PV to calculate the APD of the silica.

The purity of the amorphous silica used in this invention is not believed to be critical in terms of the adsorption of soaps and phospholipids. However, where the finished products are intended to be food grade oils care should be taken to ensure that the silica used does not contain leachable impurities which could compromise the desired purity of the product(s). It is preferred, therefore, to use a substantially pure amorphous silica, although minor amounts, i.e., less than about 10%, of other inorganic constituents may be present. For example, suitable silicas may comprise iron as $Fe_2O$, aluminum as $Al_2O_3$, titanium as $TiO_2$, calcium as CaO, sodium as $Na_2O$, zirconium as $Zr0_2$, sulfur as $SO_4$, and/or trace elements. If such impurities are present, the oxides will be included in the solids basis determination of porosity, in addition to $SiO_2$. In addition, as described above, the silica may contain caustic or acid supported in its pores, or may be used with another porous support on which the caustic is supported.

Silica adsorbents may be used in this invention as described above. Alternatively, it may be desired to improve certain properties or capacities of the silica by treating it with an organic or inorganic acid prior to use in the MPR process. For example, U.S. 4,939,115 describes amorphous silicas treated with organic acids in such a manner that at least a portion of the organic acid is retained in the silica. Such silicas have improved ability to remove trace contaminants from oils and are well suited to use in this invention. It has been found that silica containing about 2.0 to about 8.0 wt% citric acid is particularly useful, more preferably containing about 3.0 to about 5.0 wt%, and most preferably about 4.0 wt%, citric acid. Other organic acids which may be used to pretreat the silica include, but are not limited to acetic acid, ascorbic acid, tartaric acid, lactic acid, malic acid, oxalic acid, etc.

In some applications of the MPR process, it may be desired for the amorphous silica to be treated with a strong acid to improve its ability to remove chlorophyll, as well as red and yellow color bodies. Improvement in the phospholipid and soap removal capacity of the silica may also be seen. Adsorbents such as these are described in U.S. Pat. No. 4,877,765 as having supported an inorganic acid, an acid salt or a strong organic acid having a pKa of about 3.5 or lower, the treated adsorbent being characterized as having an acidity factor of at least about $2.0 \times 10^{-8}$ and a pH of about 3.0 or lower. Suitable acids include sulfuric acid, phosphoric acid, hydrochloric acid, toluene sulfonic acid, trifluoroacetic acid; suitable acid salts include magnesium sulfate and aluminum chloride.

Finally, it may be desired to pretreat the amorphous silica with caustic. In this manner, the MPR process is somewhat simplified, since the caustic and silica adsorbent are added to the oil in a single unit operation. This is described in further detail above.

Modified Physical Refining

The prior art modified caustic refining process (MCR) involves the treatment of caustic treated, primary centrifuged, water-wash centrifuged or caustic refined oils with silica adsorbents to remove soaps and phospholipids. Those oils are all caustic treated (i.e., the FFA content of the oil is neutralized by the addition of excess caustic) and subjected to one or more steps to remove soaps prior to contact with the amorphous silica adsorbent.

By contrast, the MPR process disclosed and claimed herein is designed to utilize crude or degummed oil. There is no "caustic treatment" step as that step is defined and known to the oil industry (i.e., use of sufficient caustic to neutralize FFA, with excess caustic typically used). The very high levels of soaps (7500–12,500 ppm) generated in traditional or modified caustic refining are not produced by the present method. Rather, very low levels of caustic are added to the oil to generate correspondingly low levels of soaps (20–3000 ppm, preferably 50–1500 ppm, more preferably 100–1000 ppm, and most preferably 300–800 ppm). The oil can then be directly treated with an amorphous silica adsorbent, without any intervening steps to reduce the soap content.

The oil may be treated as received or, in some instances, may be subjected to water or acid pretreatment or co-treatment step. This may be particularly desired for oils which have been partially dried (as by vacuum drying), which serves to convert hydratable phospholipids to a dehydrated (nonhydratable) form which is much more difficult to remove. For example, water degummed oils may be vacuum dried prior to further treatment for removal of phospholipids or other contaminants. The addition of small amounts of acid, such as phosphoric acid or citric acid, hydrates the phosphatide micelles, facilitating their removal by adsorption onto amorphous silica. Acetic acid, ascorbic acid, tartaric acid, lactic acid, malic acid, oxalic acid, sulfonic acid, hydrochloric acid, toluenesulfonic acid, or other organic and inorganic acids may be used. Alternatively, acid pre-treatment or co-treatment may be desirable in oils with low phospholipid content (e.g., 5–50 ppm phosphorus) to assist in adsorption. These possible uses of acid should be considered on a case-by-case basis.

As indicated, the acid may be used either in a pretreatment or co-treatment process. In the former, a small quantity of acid (e.g., 0.005 to 0.1 wt%, preferably about 0.01 wt%, or 50 to 1000 ppm, preferably about 100 ppm) is added to the oil. Preferably, this is accompanied by heating to about 50°–70° C. with agitation. Next, the MPR process is conducted as described herein. In a co-treatment process, the acid may be added at the same time as the MPR caustic addition. Pre-treatment may be preferred, to give more of the acid a chance to hydrate the phospholipids rather than neutralize the caustic.

Acid pre-treatment or co-treatment can be expected to lower silica usage by facilitating phospholipid removal. Other benefits, such as color removal, may be present. At the same time, however, the usage of caustic or base will be slightly increased. Acid present in the oil at the time of caustic addition in the MPR process will preferentially react with the caustic, resulting in a smaller quantity of caustic able to react with FFAs to create soaps. As a result, stoichiometric amounts of soaps are not created by caustic addition in this embodiment of the MPR process. For that reason, caustic addition must be increased. But even in this acid treatment embodiment, much less caustic is used than in conventional caustic treatment processes.

It will be understood that refined oils which have been treated by this MPR process still contain free fatty acids, in contrast to traditional or modified caustic refined oils. The FFA content of the treated oil will depend, of course, on the initial FFA level of the oil. In the MPR process, only a portion of the FFA typically will be neutralized, as described above. The quantity of caustic added is enough to create actual soap levels of 20 to 3000 ppm, preferably 50 to 1500 ppm, more preferably 100 to 1000 ppm and most preferably 300 to 800 ppm. The free fatty acids not removed by the partial neutralization of this process are distilled out in the deodorizer or by steam stripping, as in the case of palm oil.

The actual soap levels following the caustic addition of this invention, may not correspond to the theoretic soap levels predicted by the stoichiometry of the acid-base (FFA-caustic) reaction. Other acid-base reactions may occur upon addition of the caustic, depending on the nature and quantity of contaminants in the oil. For example, if phosphorus is present as phosphatidic acid, particularly in high concentrations, the caustic will preferentially neutralize that acid, rather than the FFAs which may be present. It will be appreciated, therefore, that in oils with high phosphorus and low FFA contents, considerably less than stoichiometric amounts of soap may be formed. It will be preferred, for most oils, that 100 to 1000 ppm soaps actually be formed in the oil following the addition of caustic. For most oils, the formation of about 300–800 ppm soaps is most preferred.

Glyceride oil characteristics vary considerably and have substantial impact on the ease with which contaminants can be removed by the various physical or chemical processes. For example, the presence of calcium or magnesium ions affects adsorption of contaminants, as do phosphorus level and source of oil (e.g., palm, soy, etc.). It is therefore not possible to strictly prescribe caustic levels for oils to be treated by the MPR processes of this invention, although general guidelines can be formulated. Based on these guidelines, it may be most advantageous to approximate the optimal caustic and adsorbent usage for each oil on the basis of a caustic ladder or a graph plotted from several laboratory treatments.

The amount of caustic addition will also depend on the silica loading which is targeted. That is, it may be desirable, for economic reasons, to first select the approximate silica usage for the process and determine from that how much caustic must be used (i.e., how much soap must be created). For example, if the silica loading target is 0.4 wt% (as is), a rough initial estimate can be made that soap levels of approximately five times the phosphorus content should be generated. In general, higher initial levels of phosphorus and other contaminants will require higher levels of caustic to create sufficient soaps for reduction of contaminants to targeted levels. It will be understood, of course, that more contaminants can be removed for a given level of caustic if more silica adsorbent is used. Conversely, higher levels of caustic may be necessary if lower silica loadings are targeted. Based on these rough approximations and on the caustic ladder or graph suggested above, the optimal caustic and silica usage for each glyceride oil, fatty chemical or wax ester can be routinely determined by one of ordinary skill in the art.

As discussed above, caustic may be added separately or supported on a porous support. If added in supported form, the support may be amorphous silica or may be another inorganic support. In the former case, additional untreated amorphous silica can be added. In the latter case, amorphous silica must be added as the adsorbent.

It is believed that the total available adsorption capacity of typical amorphous silicas is proportional to the pore volume of the silica and ranges approximately from about 50 to 400 wt% or higher on a dry basis. The silica usage preferably should be adjusted so that the total soap and phospholipid content of the caustic treated or caustic refined oil does not exceed about 50 to 400 wt% of the silica added on a dry basis. The maximum adsorption capacity observed in a particular application is expected to be a function of the specific properties of the silica used, the oil type and stage of refinement, and processing conditions such as temperature, degree of mixing and silica-oil contact time. Calculations for a specific application are well within the knowledge of a person of ordinary skill as guided by this specification. Higher silica usages may be desired to benefit oil quality in respects other than soap and phospholipid removal, such as for further improvement of oxidative stability.

The adsorption step itself is accomplished by contacting the amorphous silica and the oil, preferably in a manner which facilitates the adsorption. The adsorption step may be by any convenient batch or continuous process which provides for direct contact of the oil and the silica adsorbent. In any case, agitation or other mixing will enhance the adsorption efficiency of the silica.

The silica adsorption step of the MPR process works most advantageously at temperatures between about 25 and about 110° C., preferably between about 40° C. and about 80° C., most preferably in the 50°-70° C. range. The oil and amorphous silica are contacted as described above for a period sufficient to achieve the desired levels of soap and phospholipid in the treated oil. The specific contact time will vary somewhat with the selected process, i.e., batch or continuous. In addition, the silica adsorbent usage, that is, the relative quantity of silica brought into contact with the oil, will affect the amount of soaps and phospholipids removed. The adsorbent usage is quantified as the weight percent of amorphous silica (on a dry weight basis after ignition at 1750° F.), calculated on the basis of the weight of the oil processed. The preferred adsorbent usage on a dry weight basis is at least about 0.01 to about 1.0 wt% silica, most preferably at least about 0.1 to about 0.4 wt%. For 65 wt% TV amorphous silica, this would correspond to an as is usage of at least about 0.03 to about 3.0 wt% silica, most preferably at least about 0.3 to about 1.2 wt%.

As seen in the Examples, significant reduction in soap and phospholipid content is achieved by the method of this invention. The soap content and the phosphorus content of the treated oil will depend primarily on the oil itself, as well as on the silica, usage, process, etc. However, phosphorus levels of less than 15 ppm, preferably less than 5.0 ppm, and most preferably less than 1.0 ppm, and soap levels of less than 50 ppm, preferably less than about 10 ppm and most preferably substantially zero ppm, can be achieved by this adsorption method. It will be appreciated that caustic and/or silica levels can be adjusted to meet the requirements of individual oils. In embodiments utilizing caustic-treated inorganic porous supports, it may be necessary to add an adsorbent for the removal of soap. This may be true even where the inorganic porous support is itself an adsorbent for soap (i.e., amorphous silica or clay), if additional soap removal capacity is desired.

Following adsorption, the soap and phospholipid enriched silica is removed from the adsorbent-treated oil by any convenient means, for example, by filtration or centrifugation. The oil may be subjected to additional finishing processes, such as steam refining, bleaching and/or deodorizing. With low phosphorus and soap levels, it may be feasible to use heat bleaching for decolorization with respect to red and yellow, instead of a bleaching earth step, which is associated with significant oil losses. For example, corn, palm and sunflower oils might be treatable in this manner. Further, it has been found that the MPR process itself will reduce reds and yellows effectively in certain oils.

Even where bleaching operations are to be employed, e.g., for removal of chlorophyll, simultaneous or sequential treatment with amorphous silica and bleaching earth or pigment removal agents provides an extremely efficient overall process. By first using the method of this invention to decrease the soap and phospholipid content, and then treating with bleaching adsorbent or pigment removal agent, the effectiveness of the latter step is increased. Therefore, either the quantity of bleaching adsorbent or pigment removal agent required can be significantly reduced, or else the bleaching adsorbent or pigment removal agent will operate more effectively per unit weight. A sequential, or dual phase, packed bed treatment process is particularly preferred for oils containing chlorophyll. In such a process, the oil is treated first with the silica adsorbent by the MPR process of this invention, and then is passed through a packed bed of a bleaching adsorbent or pigment removal agent (such as bleaching earth).

The spent silica may be used in animal feed, either as is, or following acidulation to reconvert the soaps into fatty acids. Alternatively, it may be feasible to elute the adsorbed impurities from the spent silica in order to re-cycle the silica for further oil treatment.

Modified Physical Remediation

Poor quality or damaged oils may resist refining or reclamation processes, resulting in the oils being off specification with regard to contaminant levels, color or flavor reversion, or oxidation upon storage, etc. By using the MPR process on these oils, it may be possible to bring them within specification.

In order to carry out the MPR process, FFAs are added to and mixed with the oil to levels sufficient to generate about 20–3000 ppm, preferably 50 to 1500 ppm, more preferably 100 to 1000 ppm, and most preferably 300–800 ppm, soaps in the oil upon addition of caustic. Addition of FFA can be facilitated by heating the oil somewhat (i.e., to about 50° to about 70° C.) and/or by agitation. The MPR process preferably is used to neutralize about 70 to 90% of the FFA added, and to adsorb the resulting soaps. In refining operations, any excess FFA which is not neutralized by the caustic in this MPR process may be removed during deodorization, as described above. It is believed that removal of the previously difficult-to-remove contaminants will be facilitated by this application of the MPR process. Remediation of these damaged or difficult oils will result in significant savings to the oil processor.

Modified Physical Reclamation

As discussed above, use of the MPR process is not limited to the initial refining of glyceride oils, etc. Oils and fatty chemicals may become contaminated in such a manner that the MPR process of this invention can be practiced to clean-up and reclaim the oil or fatty chemical for further use. During use, especially in frying foods, oils become contaminated with phospholipids, trace metals, FFAs, proteins and other polar compounds, some of which are associated with triglycerides released from the foods during frying. Where the FFA content of the spent, or used, oil is high enough for generation of at least 20–3000 ppm, preferably 50 to 1500 ppm, more preferably 100 to 1000 ppm and most preferably 300-800 ppm soap, the MPR process will be useful in reclaiming the oil. Spent frying oils typically will comprise sufficient FFA for the MPR process, and may comprise up to about 6% FFA. This modified physical reclamation process will be essentially as described above for modified physical refining, with small quantities of caustic added to convert the FFA to soaps.

Substantial reduction of the FFA content of spent oils can be achieved by application of the MPR process. For example, reduction to about 0.01 to 0.03% FFA has been accomplished by use of MPR with caustic supported on a solid adsorbent such as silica. The embodiment using silica-supported caustic is discussed in detail above. Residual FFA could be removed by deodorizing the oil, as is typical in initial refining operations. In many cases, however, low residual FFA levels will be acceptable. For example, oils having up to about 0.4 to about 0.8% FFA may be considered acceptable for continued frying, with an upper limit of about 1.0% FFA for most frying uses. Fatty chemicals and wax esters may be reclaimed as described here if the appropriate contaminants are present as a result of use of the fatty chemical or wax ester.

The examples which follow are given for illustrative purposes and are not meant to limit the invention described herein. The following abbreviations have been used throughout in describing the invention:

Å—Angstrom(s)
APD—average pore diameter
Be—Baume
B-E-T—Brunauer-Emmett-Teller
Ca—calcium
cc—cubic centimeter(s)
cm—centimeter
Cu—copper
° C.—degrees Centigrade
db—dry basis
° F.—degrees Fahrenheit
Fe—iron
gm—gram(s)
ICP—Inductively Coupled Plasma
m—meter
Mg—magnesium
min—minutes
ml—milliliter(s)
mm—millimeter(s)
P—phosphorus
PL—phospholipids
ppm—parts per million (by weight)
PV—pore volume
%—percent
S—soaps
SA—surface area
sec—seconds
TV—total volatiles
wt—weight

EXAMPLE I

Water Degummed Soybean Oil

In this example, 600 gm water degummed SBO, analysis listed in Table II, were heated to 40° C. in a water bath. Next, 1.8 gm 18° Be (13 wt%) NaOH solution were added to the oil at atmospheric pressure with constant agitation and mixed for 30 min at 40° C. The soap content of the oil was 519 ppm.

In the adsorption step, 550 gm soapy water degummed oil were treated with 8.25 gm (1.5 wt%) (as is) TriSyl® 300 silica (60.2 wt% TV) (Davison Chemical Division, W. R. Grace & Co.-Conn.), agitating for 30 min at atmospheric pressure and 40° C. The mixture was filtered to obtain clear oil for analysis.

Prior to analysis, the MPR-processed oil was bleached and deodorized as follows to simulate the full refining process. First, 350 gm MPR-processed oil were vacuum bleached with 1.4 gm (0.4 wt%) (as is) premium acid activated bleaching earth at 100° C. for 30 min at 700 mm gauge. To minimize damage to the bleached oil, the vacuum was disconnected after cooling the oil to 70° C. Next, 250 gm bleached oil were deodorized in a laboratory glass deodorizer at the following conditions: 250° C., 60 min, 2–4 wt% steam, <1 torr vacuum; 100 ppm 20 wt% citric acid solution added at the end of deodorization. The properties o the fully refined oil are listed in Table II.

The Control treatment listed in Table II was addition of 8.25 gm (1.5 wt%) (as is) TriSyl 300 silica to 600 gm water degummed SBO with agitation for 30 min at atmospheric pressure at 40° C., followed by filtration to obtain clear oil. The Control oil was bleached and deodorized as described above.

TABLE II

| | (WATER DEGUMMED SOYBEAN OIL) | | | | | | | | |
|---|---|---|---|---|---|---|---|---|---|
| | P[1] | Ca[1] | Mg[1] | Fe[1] | Soap[2] | ChlA[3] | Color[4] | | Rancimat |
| Treatment | (ppm) | (ppm) | (ppm) | (ppm) | (ppm) | (ppm) | R | Y | hrs @ 100° C. |
| Water Degummed Oil | 88.1 | 43.1 | 24.1 | 0.6 | — | 0.40 | 15 | 70+ | — |
| NaOH | | | | | 519 | | | | |
| TriSyl 300 Silica | 1.7 | 0.7 | 0.4 | 0.0 | 0 | 0.37 | 13 | 70+ | — |
| Clay Bleached | 0.5 | 0.5 | 0.2 | 0.0 | 0 | 0.02 | 4.8 | 70+ | — |
| Deodorized Oil | 0.6 | 0.5 | 0.1 | 0.0 | 0 | 0.00 | 0.2 | 1.6 | 15.25 |
| Control-TriSyl 300 Silica | 25.4 | 15.2 | 8.0 | 0.2 | — | 0.38 | 18 | 51 | — |

[1]Trace contaminant levels measured in parts per million by ICP emission spectroscopy.
[2]Soap measured by AOCS Recommended Practice Cc 17-79.
[3]ChlA measured by automatic tintometer (5¼" cell).
[4]Red and yellow color measured by automatic tintometer (5¼" cell).

EXAMPLE II

A. Acid Degummed Soybean Oil (TriSyl® 300 Silica)

In this experiment, 800 gm acid degummed SBO, analysis listed in Table III, were heated to 50° C. in a water bath. Next, 0.8 gm (0 1 wt%) 18° Be (13 wt%) NaOH solution were added to the oil at atmospheric pressure with constant agitation and mixed for 30 min at 50° C. The soap content of the oil was 183 ppm.

In the adsorption step, 350 gm soapy acid degummed oil were heated to 70° C., then treated with 1.4 gm (0.4 wt%) (as is) TriSyl® 300 silica (Davison Chemical Division, W. R. Grace & Co.-Conn.), agitating for 30 min at atmospheric pressure. The mixture was filtered to obtain clear oil for analysis.

The oil was bleached and deodorized as described in Example I, except using 300 gm MPR-processed oil in the bleaching step and 200 gm bleached oil in the deodorizer. The properties of the oil are listed in Table III.

For comparison, Table III lists data for Caustic Refined SBO which was commercially refined (using conventional caustic refining procedures) and laboratory bleached and deodorized (as described in Example I).

Acid Degummed Soybean Oil (Citric Acid on Silica Hydrogel)

In this experiment, 800 gm acid degummed SBO, analysis listed in Table III, were heated to 50° C. in a water bath. Next, 0.8 gm (0.1 wt%) 18° Be (13 wt%) NaOH solution were added at atmospheric pressure with constant agitation and mixed for 30 min at 50° C. The soap content of the oil was 183 ppm.

In the adsorption step, 350 gm soapy acid degummed oil were heated to 70° C. and treated with 1.4 gm (0.4 wt%) (as is) silica hydrogel upon which was supported 4.0 wt% citric acid. The hydrogel, obtained from the Davison Division of W. R. Grace & Co.-Conn., had the following properties: APD=158Å; SA=339m²/gm; TV=57.3%. This adsorbent was prepared according to U.S. Pat. No. 4,939,115, by co-milling the silica hydrogel with citric acid powder. The oil/silica mixture was agitated for 30 min at atmospheric pressure. The mixture was filtered to obtain clear oil for analysis.

The oil was bleached and deodorized as described in Example I, except using 300 gm MPR-processed oil in the bleaching step and 200 gm bleached oil in the deodorizer. The properties of the oil are listed in Table III.

EXAMPLE 111

Super Degummed Canola Oil (TriSyl ® 300 Silica)

In this experiment, 1,000 gm commercially super degummed canola oil, analysis listed in Table IV, were heated to 50° C. in a water bath. Next, 0.5 gm (0.05 wt%) 18° Be (13 wt%) NaOH solution were added at atmospheric pressure with constant agitation and mixed for 30 min at 50° C. The soap content of the oil was 186 ppm.

In the adsorption step, 350 gm soapy super degummed canola oil were heated to 70° C. and treated with 3.5 gm (1.0 wt%) (as is) TriSyl ® 300 silica (Davison Chemical Division, W. R. Grace & Co.-Conn.), agitating for 30 min at atmospheric pressure. The mixture was filtered to obtain clear oil for analysis.

The oil was bleached and deodorized as described in Example I, except using 300 gm MPR-processed oil and 19.5 gm (as is) bleaching earth in the bleaching step, and 200 gm bleached oil in the deodorizer. The properties of the oil are listed in Table IV.

For comparison, Table IV lists data for Caustic Refined Canola, which was laboratory refined (using conventional caustic refining procedures with clay as the adsorbent) and then laboratory deodorized (as described in Example I).

B. Super Degummed Canola Oil (Citric Acid on Silica Hydrogel)

The experiment was repeated using the citric acid-treated silica hydrogel described in Example IIB as the adsorbent. The results are in Table IV.

TABLE III

| | (ACID DEGUMMED SOYBEAN OIL)[1] | | | | | | | | |
|---|---|---|---|---|---|---|---|---|---|
| | P (ppm) | Ca (ppm) | Mg (ppm) | Fe (ppm) | Soap (ppm) | ChlA (ppm) | Color R | Color Y | Rancimat hrs @ 100° C. |
| TriSyl 300 Silica | | | | | | | | | |
| Acid Degummed Oil | 13.4 | 1.9 | 1.8 | 0.5 | — | 0.41 | 15 | 70+ | — |
| NaOH | | | | | 243 | | | | |
| TriSyl 300 Silica | 0.0 | 0.0 | 0.0 | 0.0 | Trace | 0.41 | 14 | 70+ | — |
| Bleached Oil | 0.0 | 0.0 | 0.0 | 0.0 | 0 | 0.02 | 5.1 | 70+ | — |
| Deodorzied Oil | 0.0 | 0.0 | 0.0 | 0.0 | 0 | 0.0 | 0.1 | 1.4 | 15.00 |
| Silica-supported Citric Acid | | | | | | | | | |
| Acid Degummed Oil | 13.4 | 1.9 | 1.8 | 0.5 | — | 0.41 | 15 | 70+ | — |
| NaOH | | | | | 243 | | | | |
| CA/Silica | 0.0 | 0.0 | 0.0 | 0.0 | 15 | | | | |
| Bleached Oil | 0.0 | 0.0 | 0.0 | 0.0 | 0 | 0.02 | 6.2 | 70+ | — |
| Deodorized Oil | 0.0 | 0.0 | 0.0 | 0.0 | 0 | 0.00 | 0.0 | 1.4 | 16.25 |
| Caustic Refined SBO[2] Deodorized Oil | <0.25 | 0.2 | 0.1 | <0.03 | 0 | 0.02 | 1.0 | 4.5 | 14.60 |

[1]See Table II footnotes for analytical procedures used.
[2]Data from oil refined in a commercial plant using continuous addition of clay only; oil was then laboratory deodorized.

TABLE IV

| | (SUPER DEGUMMED CANOLA OIL)[1] | | | | | | | | |
|---|---|---|---|---|---|---|---|---|---|
| | P (ppm) | Ca (ppm) | Mg (ppm) | Fe (ppm) | Soap (ppm) | ChlA (ppm) | Color R | Color Y | Rancimat hrs @ 100° C. |
| TriSyl 300 Silica | | | | | | | | | |
| Super Degummed Oil | 32.8 | 9.8 | 3.8 | 1.8 | — | 26.4 | TD[2] | TD | — |
| NaOH | | | | | 186 | | | | |
| TriSyl 300 Silica | 6.1 | 2.2 | 0.8 | 0.4 | 0 | 26.4 | TD | TD | — |
| Bleached Oil | 0.6 | 0.0 | 0.0 | 0.0 | 0 | 0.05 | 1.4 | 36 | — |
| Deodorized Oil | 0.7 | 0.0 | 0.0 | 0.0 | 0 | 0.01 | 0.3 | 2.9 | 20.75 |
| Silica-supported Citric Acid | | | | | | | | | |
| Super Degummed Oil | 32.8 | 9.8 | 3.8 | 1.8 | — | 26.4 | TD | TD | — |
| NaOH | | | | | 186 | | | | |
| CA/Silica | 7.5 | 2.6 | 0.9 | 0.6 | 0 | 26.4 | TD | TD | — |

TABLE IV-continued

| | (SUPER DEGUMMED CANOLA OIL)[1] | | | | | | | | |
|---|---|---|---|---|---|---|---|---|---|
| | P (ppm) | Ca (ppm) | Mg (ppm) | Fe (ppm) | Soap (ppm) | ChlA (ppm) | Color R | Color Y | Rancimat hrs @ 100° C. |
| Bleached Oil | 0.7 | 0.0 | 0.0 | 0.0 | 0 | 0.03 | 1.6 | 37 | |
| Deordorized Oil | 0.7 | 0.0 | 0.0 | 0.0 | 0 | 0.00 | 0.3 | 2.6 | 20.75 |
| Caustic Refined Canola[3] Deodorized Oil | 0.4 | 0.0 | 0.0 | 0.0 | 0 | 0.00 | 0.6 | 4.0 | 20.00 |

[1]See Table II footnotes for analytical procedures used.
[2]TD = Too dark to analyze by this method.
[3]Data from laboratory refined oil; oil was then laboratory bleached (clay only) and deodorized.

EXAMPLE IV

Crude Palm Oil

In this example, 500 gm crude palm oil, analysis listed in Table V, were heated to 40° C. in a water bath. Next, 0.25 gm of 18° Be (13 wt%) NaOH solution were added to the oil at atmospheric pressure with constant agitation and mixed for 30 min at 40° C. The soap content of the oil was 457 ppm.

In the adsorption step, 490 gm soapy crude palm oil were heated to 68° C., then treated with 2.45 gm (0.5 wt%) (as is) TriSyl® 300 silica (Davison Chemical Division, W. R. Grace & Co.-Conn.), agitating for 30 min at atmospheric pressure. The mixture was filtered to obtain clear oil for analysis.

added and agitated for 20 min. Finally, 1.273 gm 18° Be (13 wt%) NaOH solution were added at atmospheric pressure with constant agitation and mixed for 30 min at 70° C. The soap content of the oil was 700 ppm.

The temperature of the soapy crude palm oil was maintained at 70° C., and the oil was treated with 9.6 gm (0.8 wt%) (as is) TriSyl® 300 silica (Davison Chemical Division, W. R. Grace & Co.-Conn.). The oil was agitated for 30 min at atmospheric pressure, then filtered to obtain clear oil for analysis.

The oil was bleached and deodorized as in Example IV. The properties of the oil are listed in Table V.

For comparison, Table V lists data for laboratory produced physically refined palm oil, refined as described in Example IV.

TABLE V

| | (CRUDE PALM OIL) | | | | | | | | |
|---|---|---|---|---|---|---|---|---|---|
| | P (ppm) | Ca (ppm) | Mg (ppm) | Fe (ppm) | Soap (ppm) | ChlA (ppm) | Color R | Color Y | Rancimat hrs @ 100° C. |
| MPR - NaOH Only | | | | | | | | | |
| Crude Palm Oil | 9.4 | 10.7 | 2.7 | 3.8 | — | 0.40 | TD[1] | TD | — |
| NaOH | | | | | 243 | | | | |
| TriSyl 300 Silica | 4.4 | 5.2 | 1.0 | 0.9 | 0 | 0.18 | TD | TD | — |
| Bleached Oil | 1.9 | 2.8 | 0.5 | 0.4 | 0 | 0.00 | 14 | 20 | — |
| Deodorized Oil | 2.2 | 3.2 | 0.5 | 0.4 | 0 | 0.00 | 1.5 | 15 | 31.25 |
| MPR - $H_3PO_4$ & NaOH | | | | | | | | | |
| Crude Palm Oil | 9.4 | 10.7 | 2.7 | 3.8 | — | 0.40 | TD | TD | — |
| NaOH/$H_3PO_4$ | | | | | 700 | | | | |
| TriSyl 300 Silica | 0.6 | 0.2 | 0.0 | 0.1 | 0 | 0.40 | TD | TD | — |
| Bleached Oil | 0.4 | 0.0 | 0.0 | 0.1 | 0 | 0.20 | TD | TD | — |
| Deodorized Oil | 0.0 | 0.1 | 0.0 | 0.0 | 0 | 0.00 | 1.3 | 13 | 28.25 |
| Traditional Physical Refining[2] | | | | | | | | | |
| Crude Palm Oil | 9.4 | 10.7 | 2.7 | 3.8 | — | 0.40 | TD | TD | — |
| Bleached Oil | 1.5 | 2.2 | 0.4 | 0.3 | — | 0.00 | TD | TD | — |
| Deodorzied Oil | 1.3 | 2.4 | 0.5 | 0.4 | — | 0.00 | 1.6 | 14 | 26.75 |

[1]TD = Too dark to analyze by this method.
[2]Data from laboratory refining described in Example IV.

The oil was bleached and deodorized as in Example I, except using 1.75 gm bleaching earth and deodorizing at 260° C. The properties of the oil are listed in Table V.

For comparison, Table V lists data for laboratory produced physically refined palm oil, using conventional physical refining procedures. Crude palm oil was treated with 70 ppm (0.007 wt%) of 85 wt% phosphoric acid, followed by vacuum batch bleaching with 1.0 wt% (as is) premium acid activated clay. The oil was deodorized at 260° C. as described in Example I.

EXAMPLE V

Crude Palm Oil Acid Pretreatment)

In this example, an acid treatment step was included in order to facilitate hydration of the phospholipids in the oil. First, 1,200 gm crude palm oil, analysis listed in Table V, were heated to 68° C. in a water bath. Next, 0.084 gm (0.05 wt%) 85 wt% phosphoric acid were

EXAMPLE Vi

Acid Degummed SBO (Caustic-Treated Silica Adsorbent)

In this example, 350 gm acid degummed SBO, analysis listed in Table VI, were heated to 70° C. in a water bath. Next, 0.7 gm (0.2 wt%) caustic-treated silica adsorbent were added at atmospheric pressure with constant agitation. This adsorbent was a silica hydrogel whose pores contained nominal 10 wt% sodium carbonate. The silica hydrogel was characterized as having APD=210Å and SA=362 $m^2$/gm. The oil and the adsorbent were mixed for 30 min at 70° C. The oil was filtered to obtain clear oil for analysis. The soap content of the MPR-processed oil was 333 ppm.

The oil was bleached and deodorized as in Example I, except using 200 gm MPR-processed oil and 1.05 gm bleaching earth in the bleaching step, and 200 gm bleached oil in the deodorizer. The properties of the oil are listed in Table VI. Although significant quantities of soap remained in the oil following contact with the caustic-treated adsorbent, the example does demonstrate the possibilities for addition of caustic in this manner for the MPR process. It is believed that the high remaining soap level in this experiment was due to a relative excess of caustic over silica. It can be seen that reduction of the supported caustic content or increase in available silica capacity will optimize this embodiment of the MPR invention. Alternatively, the process described can be supplemented with or followed by treatment with an adsorbent having soap removal capacity, such as clay or amorphous silica.

For comparison, Table VI lists data for Caustic Refined SBO which was commercially refined (using conventional caustic refining procedures) and laboratory deodorized (as described in Example I).

TABLE VI

| | (ACID DEGUMMED SOYBEAN OIL)[1] | | | | | | | | |
|---|---|---|---|---|---|---|---|---|---|
| | P (ppm) | Ca (ppm) | Mg (ppm) | Fe (ppm) | Soap (ppm) | ChlA (ppm) | Color R | Color Y | Rancimat hrs @ 100° C. |
| Silica-Supported Caustic | | | | | | | | | |
| Acid Degummed Oil | 9.8 | 1.7 | 1.5 | 0.1 | — | 0.44 | 15 | 70+ | — |
| Caustic/Silica | | | | | 333 | | | | |
| Bleached Oil | 2.1 | 1.2 | 0.6 | 0.0 | 0 | 0.10 | 9.4 | 70+ | — |
| Deodorized Oil | 1.9 | 1.2 | 0.6 | 0.0 | 0 | 0.05 | 0.2 | 1.9 | 16.50 |
| Caustic Refined SBO | | | | | | | | | |
| Deodorized Oil[2] | <0.25 | 0.2 | 0.1 | <0.03 | 0 | 0.02 | 1.0 | 4.5 | 14.60 |

[1]See Table II footnotes for analytical procedures used.
[2]Data from oil refined in a commercial plant using continuous addition of clay only; oil was then laboratory deodorized.

EXAMPLE VII

Modified Physical Remediation

The MPR process can be used on damaged oil in the following manner, for example with refined and deodorized soybean oil that has undergone color and/or flavor reversion upon storage. For a 250 gm quantity of oil, add 0.025–0.1 wt% free fatty acid (e.g., oleic acid), facilitating the addition by heating the oil to 70° C. and agitating. Next, 0.025–0.1 gm 18° Be (13 wt%) NaOH solution is added, stirring for 10 min at 70° C., to neutralize 90% of the oleic acid, creating about 0.024–096 gm soap (97–388 ppm).

In the adsorption step, the soapy oil is treated with 0.3 gm (0.12 wt%) (as is) amorphous silica (65% TV) at 70° C. with agitation for 10 min. Next, the oil is treated by stirring under vacuum for 30 min to remove excess moisture, and the adsorbent removed by filtration. It is expected that the undesired color and oxidation products would be removed from the oil along with the soaps. The oil may be further deodorized, if desired.

EXAMPLE VIII

Modified Physical Remediation (Caustic-Treated Silica Adsorbent)

The MPR process of Example VII can be modified by using a caustic-treated silica adsorbent instead of separate addition of caustic and amorphous silica. To the oil/FFA mixture of Example VII is added 0.3 gm (0.125 wt%) (as is) of a caustic-treated adsorbent such as that described in Example VI at 70° C., stirring for 10 min. Vacuum is applied and the adsorbent containing the contaminants removed from the oil by filtration, as in Example VII.

EXAMPLE IX

Modified Physical Reclamation

The MPR process can be used on spent frying oil in the following manner, for reclamation of the oil for further use. For a 250 gm quantity of used frying oil containing 3.0 wt% FFA, heated to 70° C., 0.3 wt% 18° Be (13 wt%) NaOH solution is added, stirring for 10 min, creating about 2828 ppm soap.

In the adsorption step, the soapy oil is treated with about 0.5 to 1.0 wt% (as is) amorphous silica (65% TV) at 70° C., with agitation, for 10 min. Next, the oil is heated to 100° C. and stirred under vacuum to remove excess moisture, and the adsorbent removed by filtration. This treatment would be expected to remove substantial quantities of FFA, phospholipids and color bodies. Particulate matter, partially oxidized degradation products and volatile degradation products may also be removed. Remaining FFA and residual volatiles would be removed by deodorization.

EXAMPLE X

P Removal As A Function of Caustic Addition

Commercially water degummed SBO having initial phosphorus of 133.0 ppm, analysis listed in Table VII, was heated to 50° C. Next, the quantity of 18° Be (13 wt%) NaOH specified in Table VII was added to each oil sample at atmospheric pressure with constant agitation and mixed for 30 min. The soap content of the sample is specified in Table VII.

In the adsorption step, the soapy oil was treated with the adsorbent loadings of Table VII. The adsorbent was TriSyl® silica (Davison Division of W. R. Grace & Co.-Conn.) upon which was supported 4.0 wt% citric acid. This adsorbent was prepared in the manner described in Example IIB. The oil/adsorbent mixture was agitated for 30 min at atmospheric pressure and 50° C. The mixture was filtered to obtain clear oil for analysis.

The oil was analyzed as is. The properties of the oil are listed in Table VII.

TABLE VII

| | Adsorbent (wt %) | P[1] (ppm) | Fe[1] (ppm) | Soap[2] (ppm) |
|---|---|---|---|---|
| Water Degummed SBO | — | 133.0 | 0.89 | — |
| 0.1 wt % 18° Be | 0.4 | 66.4 | 0.59 | 46 |
| NaOH solution | 0.6 | 50.6 | 0.48 | 18 |
| (Initial Soap = 219 ppm) | 0.8 | 44.6 | 0.42 | 12 |
| | 1.0 | 38.5 | 0.35 | Trace |
| | 1.2 | 32.4 | 0.34 | 0 |
| 0.3 wt % 18° Be | 0.4 | 46.4 | 0.47 | 70 |

TABLE VII-continued

| | Adsorbent (wt %) | P[1] (ppm) | Fe[1] (ppm) | Soap[2] (ppm) |
|---|---|---|---|---|
| NaOH solution | 0.6 | 42.0 | 0.36 | 52 |
| (Initial Soap = 304 ppm) | 0.8 | 32.6 | 0.32 | 24 |
| | 1.0 | 27.8 | 0.29 | 18 |
| | 1.2 | 20.6 | 0.19 | 12 |
| 0.5 wt % 18° Be | 0.4 | 14.8 | 0.25 | 62 |
| NaOH solution | 0.6 | 9.7 | 0.21 | 62 |
| (Initial Soap = 563 ppm) | 0.8 | 4.4 | 0.21 | 58 |
| | 1.0 | 2.8 | 0.17 | 37 |
| | 1.2 | 0.7 | 0.17 | 24 |
| 0.7 wt % 18° Be | 0.4 | 3.3 | 0.04 | 137 |
| NaOH solution | 0.6 | 1.7 | 0.00 | 122 |
| (Initial Soap = 671 ppm) | 0.8 | 1.2 | 0.00 | 56 |
| | 1.0 | 0.9 | 0.00 | 30 |
| | 1.2 | 0.4 | 0.00 | 18 |

[1]Trace contaminant levels measured in parts per million by ICP emission spectroscopy.
[2]Soap measured by AOCS Recommended Practice Cc 17-79.

EXAMPLE xi

P Removal As A Function of Caustic Addition

The procedures of Example X were repeated with a laboratory water degummed SBO, initial phosphorus of 78.5 ppm, analysis listed in Table VIII. The same adsorbent was used. The properties of the oil are listed in Table VIII.

TABLE VIII

| | Adsorbent (wt %) | P[1] (ppm) | Ca[1] (ppm) | Mg[1] (ppm) | Fe[1] (ppm) | Soap[2] (ppm) |
|---|---|---|---|---|---|---|
| Water Degummed SBO | — | 78.5 | 35.6 | 20.9 | 0.50 | — |
| 0.1 wt % 18° Be NaOH solution | 0.4 | 40.2 | 19.5 | 11.2 | 0.7 | 24 |
| (Initial Soap = 85 ppm) | 0.6 | 31.3 | 14.7 | 7.9 | 0.16 | 18 |
| | 0.8 | 32.7 | 14.5 | 7.6 | 0.20 | 0 |
| | 1.0 | 21.1 | 8.8 | 4.4 | 0.08 | 0 |
| 0.3 wt % 18° Be NaOH solution | 0.4 | 17.6 | 10.4 | 5.3 | 0.06 | 15 |
| (Initial Soap = 304 ppm) | 0.6 | 11.8 | 6.7 | 3.3 | 0.05 | 9 |
| | 0.8 | 6.5 | 3.7 | 1.8 | 0.00 | 6 |
| | 1.0 | 3.2 | 2.1 | 0.9 | 0.00 | Trace |
| 0.5 wt % 18° Be NaOH solution | 0.4 | 1.0 | 0.8 | 0.4 | 0.00 | 42 |
| (Initial Soap = 624 ppm) | 0.6 | 0.6 | 0.4 | 0.2 | 0.03 | 27 |
| | 0.8 | 0.5 | 0.2 | 0.1 | 0.00 | 21 |
| | 1.0 | 0.6 | 0.2 | 0.1 | 0.00 | 21 |

[1]Trace contaminant levels measured in parts per million by ICP emission spectroscopy.
[2]Soap measured by AOCS Recommended Practice Cc 17-79.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A process for refining a fatty material selected from the group consisting of glyceride oils, fatty chemicals and wax esters, said fatty material containing free fatty acid and phospholipid, said process comprising:
   (a) treating said material with a base to react a portion of the free fatty acid to form about 20–3000 ppm soap whereby said treated material contains a remaining portion of unreacted free fatty acid,
   (b) contacting said treated material from step (a) with an amorphous silica adsorbent to adsorb phospholipid and soap onto said adsorbent,
   (c) separating the adsorbent, the adsorbed phospholipid, and the adsorbed soap from the material to produce a partially refined material, and
   (d) treating the partially refined material to remove said remaining portion of free fatty acid.

2. The process of claim 1 in which said amorphous silica contains an organic acid, an inorganic acid or an acid salt supported in its pores.

3. The process of claim 1 in which said amorphous silica adsorbent is a silica hydrogel.

4. The process of claim 1 in which about 50 to about 1500 ppm of soap are formed by said reacting in step (a).

5. The process of claim 4 in which about 100 to 1,000 ppm of soap are formed in step (a).

6. The process of claim 4 in which about 300 to 800 pps of soap are formed in step (a).

7. The process of claim 6 in which said amorphous silica contains an organic acid, an inorganic acid or an acid salt supported in its pores.

8. The process of claim 7 in which said amorphous silica contains between about 2.0 and 6.0 weight percent citric acid in its pores.

9. The process of claim 1 in which said amorphous silica comprises a hydrogel or a partially dried hydrogel.

10. The process of claim 1 in which comprises using between about 0.01 and about 1.0 weight percent amorphous silica adsorbent in step (a).

11. The process of claim 1 in which said base is selected from the group consisting of an amine, an ethoxide, a carbonate, a hydroxide or a phosphate.

12. The process of claim 1 in which said base is in the form of an alcohol solution.

13. The process of claim 1 in which said amorphous silica adsorbent is contained in a packed bed.

14. The process of claim 1 wherein at least a portion of said amorphous silica adsorbent contains base in its pores, such that steps (a) and (b) occur simultaneously.

15. A process for refining a fatty material selected from the group consisting of glyceride oils, fatty chemicals and wax esters, said fatty material containing phospholipid, said process comprising:
   (a) adding free fatty acid to said material to form a modified material,
   (b) treating said modified material with a base to react a portion of the free fatty acid to form about 20–3000 ppm soap,
   (c) contacting said soap-containing material with an amorphous silica adsorbent to adsorb said soap and said phospholipid onto said adsorbent,
   (d) separating said adsorbent, said adsorbed soap and said adsorbed phospholipid from the soapcontaining material to produce a partially refined material, and
   (e) treating the partially refined material to remove the remaining portion of free fatty acid.

* * * * *